US007513476B1

(12) United States Patent
Huang

(10) Patent No.: US 7,513,476 B1
(45) Date of Patent: Apr. 7, 2009

(54) COSMETIC PEDESTAL MIRROR

(75) Inventor: Chih-Hung Huang, Lugang Township, Changhua County (TW)

(73) Assignee: Mirror King Enterprise Co., Ltd., Lugang Township (TW)

( * ) Notice: Subject to any disclaimer, the term of this patent is extended or adjusted under 35 U.S.C. 154(b) by 0 days.

(21) Appl. No.: 11/877,708

(22) Filed: Oct. 24, 2007

(51) Int. Cl.
*A47F 1/14* (2006.01)

(52) U.S. Cl. ..... 248/474; 248/910

(58) Field of Classification Search ..... 248/910, 248/469, 474, 121, 122.1, 127, 176.1, 188.1, 248/346.01
See application file for complete search history.

*Primary Examiner*—Korie Chan
(74) *Attorney, Agent, or Firm*—Alan Kamrath; Kamrath & Associates PA

(57) ABSTRACT

A cosmetic pedestal mirror has a base composed of a glass disk hood with a thickness combined with a bottom board. The bottom board has an outer surface pasted with a slip-proof pad. The glass disk hood has an outer surface embedded with decorative pieces and an interior surface coated with a decorative coating layer. The glass disk hood has a through hole defined at its center to allow a bolt with a smaller diameter on a connecting rod to penetrate and cooperate with a securing element for fixing. Thereby, the cosmetic pedestal mirror has reduced manufacturing cost and improved utility and appearance and does not need electroplating treatment to eliminate environmental issues.

2 Claims, 7 Drawing Sheets

COSMETIC PEDESTAL MIRROR

BACKGROUND OF THE INVENTION

1. Field of the Invention

The present invention relates to a cosmetic pedestal mirror and, more particularly, to a cosmetic pedestal mirror that does not have weighting blocks and does not need polishing and electroplating processes in manufacture.

2. Description of Related Art

Conventional cosmetic mirrors are suspended to the wall or combined with a vanity to help users to check their appearance. Thus, the conventional cosmetic mirror is immovable and can not be adjusted in angles. Another conventional movable cosmetic mirror is a single piece embedded in a cosmetic case and has to be held by hands when using. Therefore, it is troublesome and inconvenient in use, and the holding hand will be tired or numb without other support after a spell. Meanwhile, trimming the cloth and face by only one hand is more difficult than by two hands.

To overcome the foregoing drawbacks, a modified desk cosmetic mirror as shown in FIGS. 1 and 2 is provided. The desk cosmetic mirror substantially comprises a base 10 mounted with an erect connecting rod 20, an arc mirror frame 30 mounted on the connecting rod 20, and a dual-side round mirror 40 pivotally mounted on the mirror frame 30. The base 10 is a thin outer shell 101 made of metallic material and having a weighting block 102 wrapped with a plastic coating layer. The connecting rod 20 has a bolt 201 extending from a lower end and with a smaller diameter that penetrates through holes 1011, 1021 on the outer shell 101 and the weighting block 102. The bolt 201 cooperates with cushion A and nut B for securing the connecting rod 20 and the base 10 together. Moreover, the outer shell 101 has a bottom combined with a bottom board 103 for closing the bottom of the outer shell 101, and the bottom board 103 has a fixing hole 1031 defined at its center to allow the bolt 201 of the connecting rod 20 to penetrate therethrough to cooperate with another nut C for securing the bottom board 103 and the outer shell 101 together. Additionally, a slip-proof pad 104 is attached to an outer surface of the bottom board 103 to keep the cosmetic mirror stably placed.

However, the later conventional cosmetic mirror still has some drawbacks in actual practice that need to be resolved:

1. The base 10 needs to combine with the weighting block 102, and its surface needs polishing and electroplating processes so that the manufacturing cost is high.

2. Aside from the waste water generated by the electroplating process caused by the treatment of the outer shell 101 of the base 10, the outer shell 101 and the weighting block 102 of the base 10 are highly difficult in recycling when the cosmetic mirror is damaged. Therefore, the damaged cosmetic mirror causes more environmental problems.

3. Although the outer shell 101 of the base 10 is treated by the electroplating process, it still has a rusting problem after a period of time. If the base 10 is made of wood, the durability is poor, and the base 10 becomes rotten soon.

4. The base 10 does not have variety in appearance so that it is monotonous and the decorative efficiency and quality are decreased.

SUMMARY OF THE INVENTION

One main objective of the present invention is to provide a cosmetic pedestal mirror that has an adjusted weight of a glass disk hood serving as a base to lower the center of gravity to eliminate the weighting block and to eliminate polishing and electroplating treatments to reduce the manufacturing cost and increase economic efficiency.

Another main objective of the present invention is to provide a cosmetic pedestal mirror that uses the glass disk hood without electroplating coating to replace a metal outer shell so that the base can be recycled after being disassembled and causing no environmental problems when the cosmetic pedestal mirror is damaged.

Still another main objective of the present invention is to provide a cosmetic pedestal mirror that uses the glass disk hood to replace the conventional metal outer shell with the weighting block so that the base does not deteriorate, to obtain better utility.

Further another main objective of the present invention is to provide a cosmetic pedestal mirror that has the glass disk hood inlayed with decorative pieces and coated with a decorative layer on the interior surface so that both can be varied in different combinations to increase appearance variety and thus to increase the decorative and quality efficiencies.

To achieve the foregoing objectives, the cosmetic pedestal mirror comprises:

a base with a connecting rod erected thereon, a mirror frame mounted on the connecting rod, and a mirror pivotally mounted within the mirror frame, wherein the connecting rod has a smaller-diameter bolt extending from a lower end to penetrate the base to cooperate with a securing element for assembly;

the base is composed of a glass disk hood with a bottom closed with a bottom board; an outer surface of the bottom board is pasted with an slip-proof pad; an interior surface of the glass disk hood is coated with a decorative coating layer; and a through hole is defined at a center of the glass disk hood to allow the smaller-diameter bolt on the lower end of the connecting rod to penetrate therethrough.

Further benefits and advantages of the present invention will become apparent after a careful reading of the detailed description with appropriate reference to the accompanying drawings.

DETAILED DESCRIPTION OF THE PREFERRED EMBODIMENT

A cosmetic pedestal mirror in accordance with the present invention has a base composed of a glass disk hood with a thickness combined with a bottom board for closing. The bottom board has an outer surface pasted with a slip-proof pad. The glass disk hood has an outer surface embedded with decorative pieces and an interior surface coated with a decorative coating layer. The glass disk hood has a through hole defined at its center to allow a bolt with a smaller diameter on a connecting rod to penetrate and cooperate with a securing element for fixing. Thereby, the cosmetic pedestal mirror has reduced manufacturing cost and improved utility and appearance and does not need electroplating treatment to eliminate environmental issues.

Figure 1:
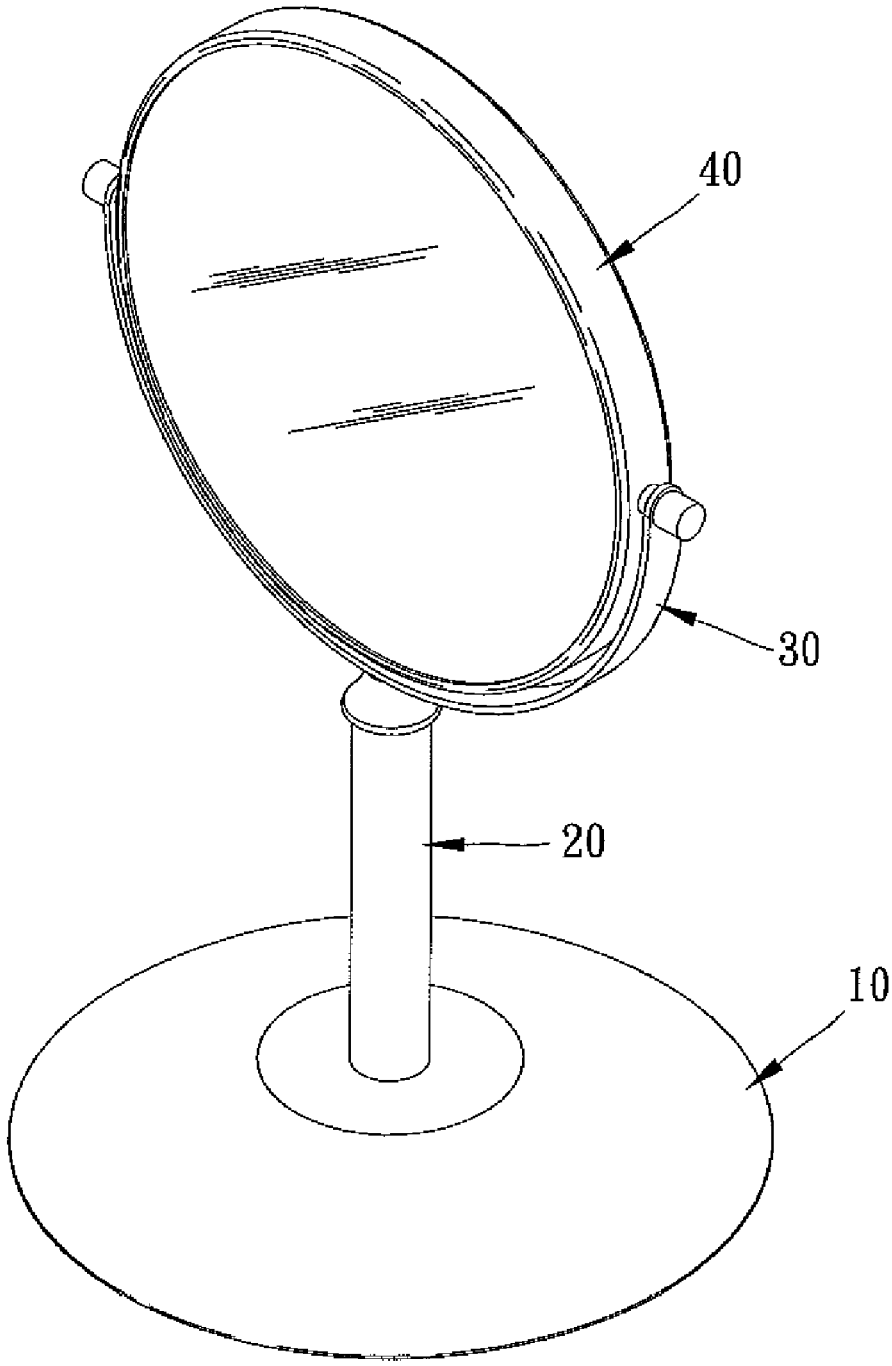
FIG. 1 PRIOR ART
FIG. 1 is a perspective view of a conventional cosmetic mirror in accordance with the prior art.
Figure 2:
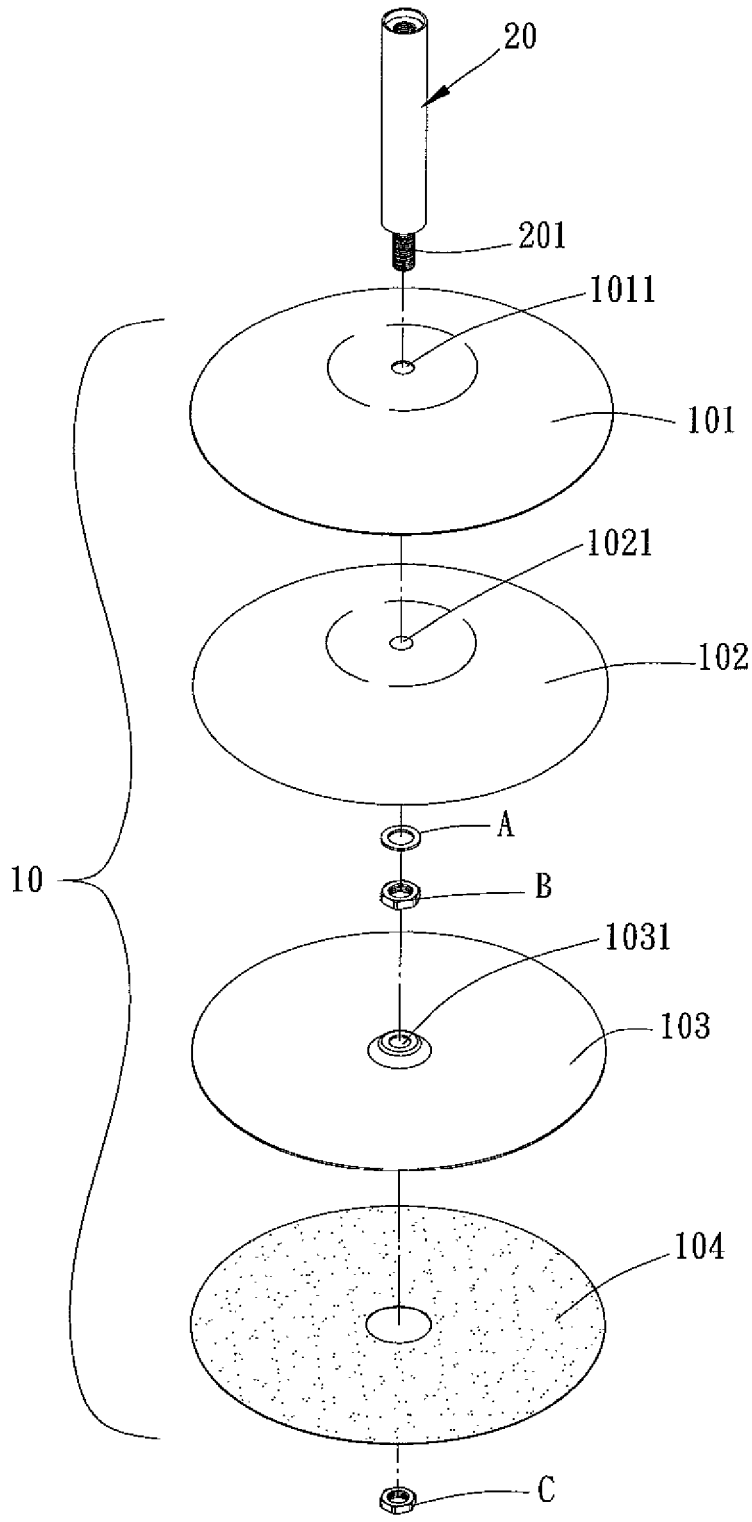
FIG. 2 PRIOR ART
FIG. 2 is a partially exploded perspective view of the conventional cosmetic mirror showing a base with a connecting rod in FIG. 1.
Figure 3:
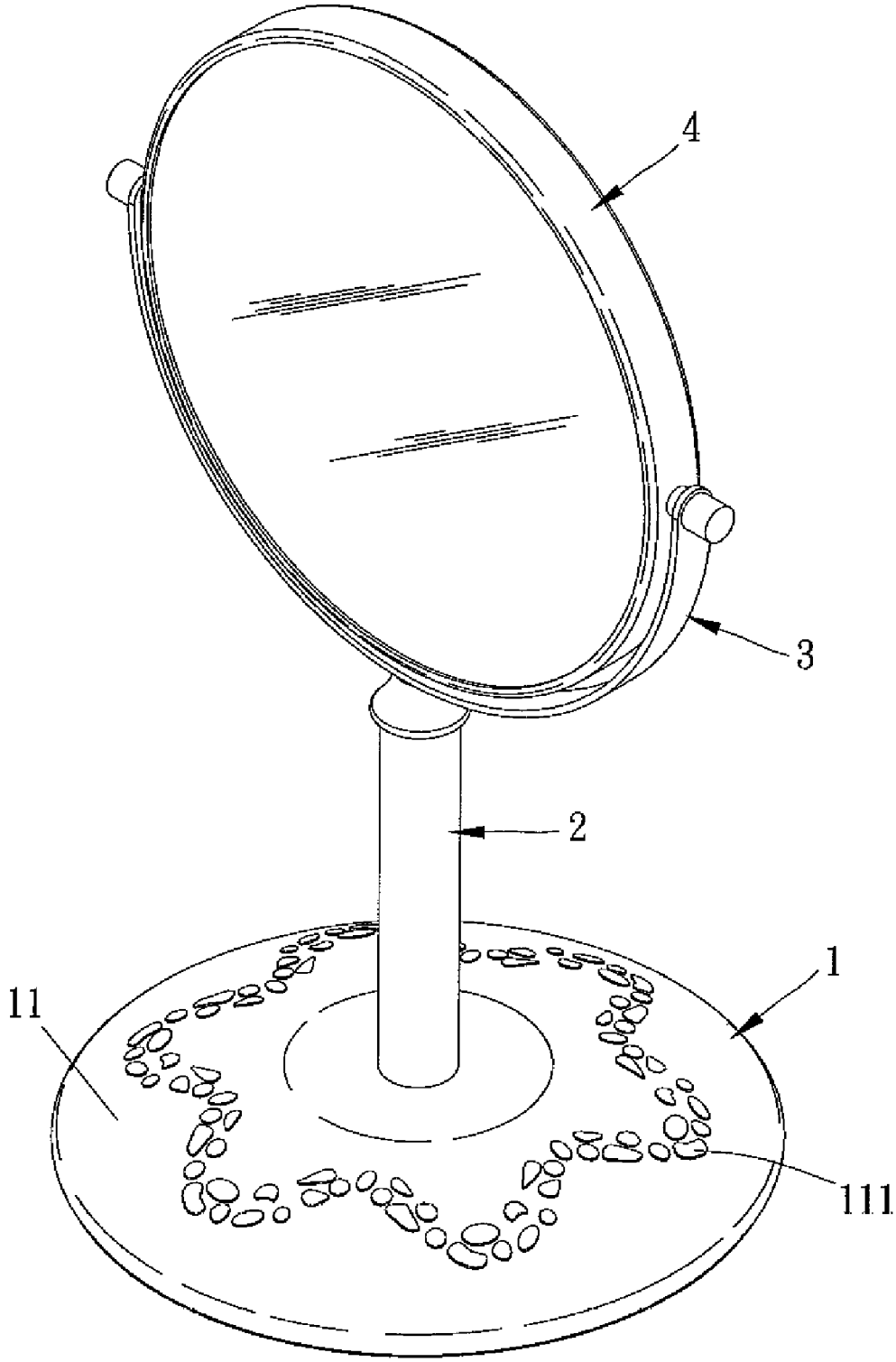
FIG. 3 is a perspective view of the cosmetic pedestal mirror in accordance with the present invention.
Figure 4:
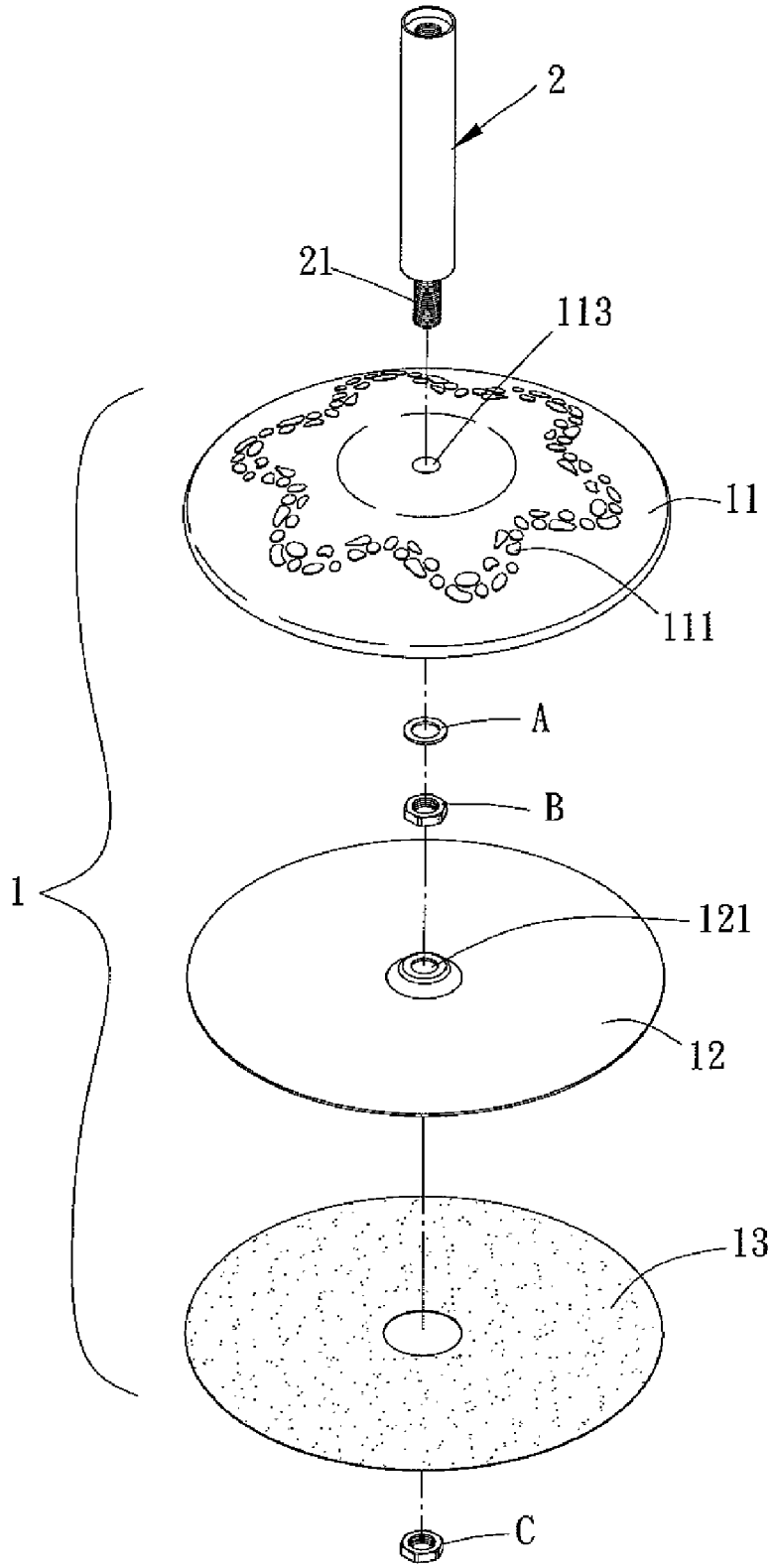
FIG. 4 is a partially exploded perspective view of a base in the present invention.
Figure 5:
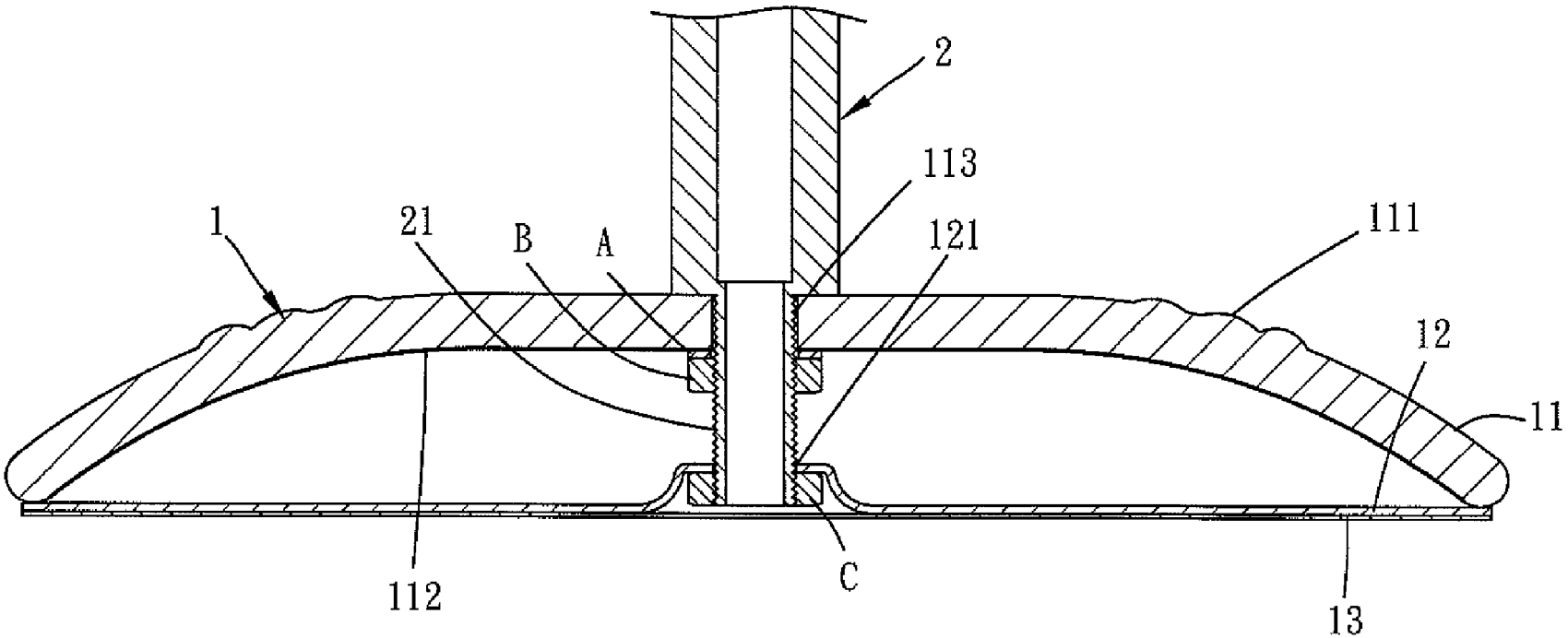
FIG. 5 is a cross-sectional side view of the base assembled with a connecting rod in the present invention.

As shown in FIGS. 3 to 5, a preferred embodiment of the cosmetic pedestal mirror comprises a base 1 mounted with an erect connecting rod 2. An arc mirror frame 3 is mounted on the connecting rod 2, and a dual-side round mirror 4 is pivotally mounted on the mirror frame 3. The base 1 comprises glass disk hood 11, a bottom board 12, and a slip-proof pad 13. The glass disk hood 11 is shaped by a mold and has a proper thickness, particularly an enhanced thickness, to obtain enough weight to keep the base 1 steady without a weighting block. Particularly, the glass disk hood 11 has the enhanced thickness of 4.0 mm to 5.0 mm and an outer diameter of 150 mm to provide 396 g in this preferred embodiment to replace a conventional iron base with 0.8 mm-1.0 mm thickness and 110 g weight in the same outer diameter and the conventional weighting block with 200 g-250 g. The glass disk hood 11 has an outer surface embedded with multiple decorative pieces 111 that is selectively mono-color or multi-color. In practice, the decorative pieces 11 are made of glass pieces and glass marbles. Because the glass disk hood 11 is shaped by high temperature melting to glass, the glass pieces can be placed in the melted glass to combine during the formation of the glass disk hood 11. The glass pieces are selectively added with pigments and arranged into word forms or patterns in the glass disk hood 11 to create more versatility. An inter surface of the glass disk hood 11 is coated with a decorative coating layer 112. A through hole 113 is defined at a center of the glass disk hood 11. The bottom board 12 corresponds to the bottom of the glass disk hood 11 in shape and has a fixing hole 121 defined at its center. The slip-proof pad 13 also corresponds to the bottom board 12 in shape. The connecting rod 2 has a bolt 21 extending from a lower end and with a smaller diameter.

The smaller-diameter bolt 21 on the lower end of the connecting rod 2 penetrates the through hole 113 on the glass disk hood 11 to combine and cooperate with cushion A and nut B to secure, thereby, the base 1 and the connecting rod 2 together. Then, the bottom board 12 is attached to the bottom of the glass disk hood 11 to make the smaller-diameter bolt 21 of the connecting rod 2 to penetrate through the fixing hole 121 on the bottom board 12 and then to combine with another nut C for securing the bottom board 12 and the glass disk hood 11 together. Furthermore, the slip-proof pad 13 is attached to an outer surface of the bottom board 12 to make the cosmetic pedestal mirror stable.

Figure 6:
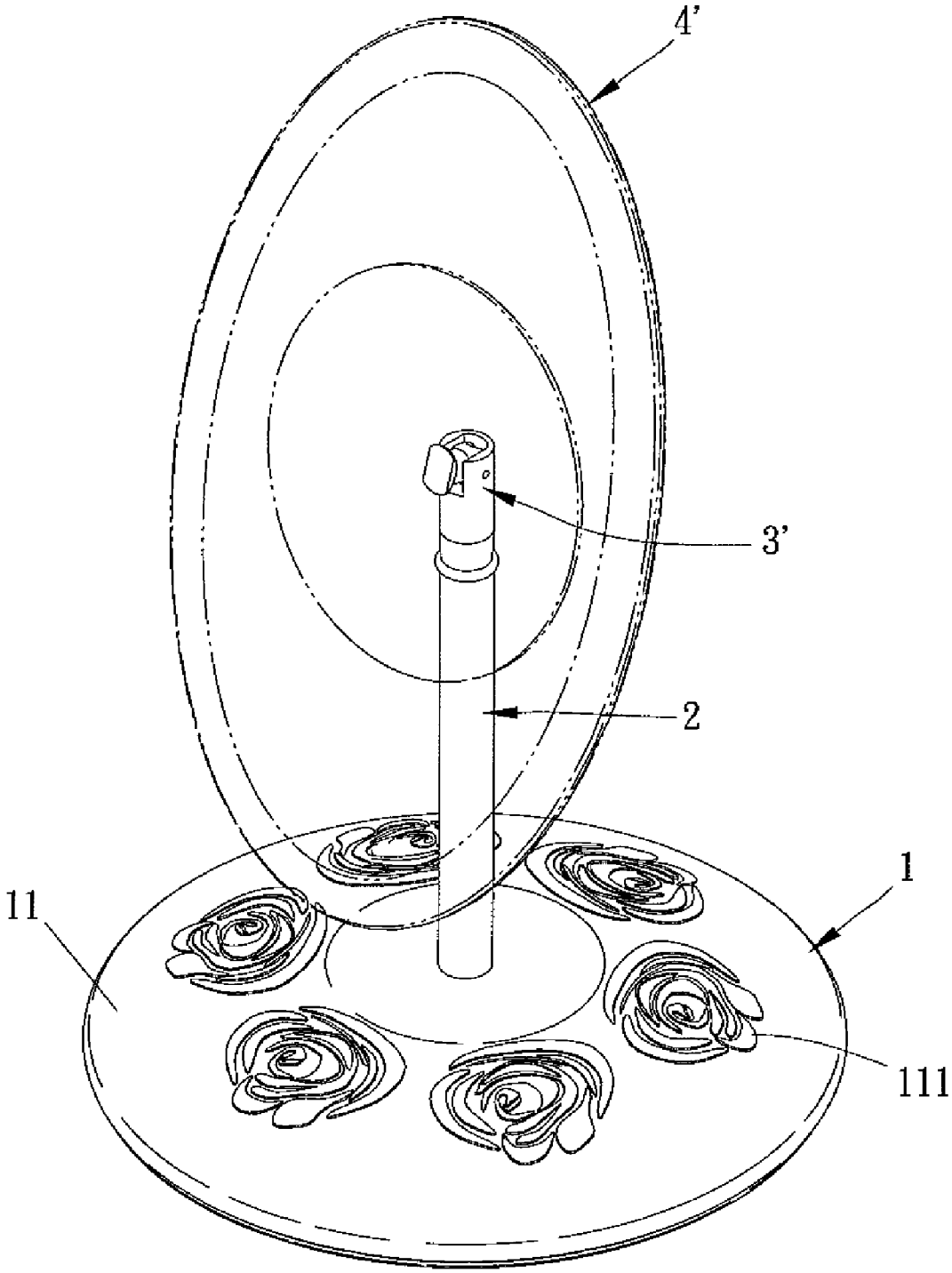
FIG. 6 is perspective view of another embodiment of the cosmetic pedestal mirror in accordance with the present invention.

Moreover, the decorative piece 111 on the outer surface of the glass disk hood 11 of the base 1, the mirror frame 3' and the mirror 4' are arranged as shown in FIG. 6.

Figure 7B:
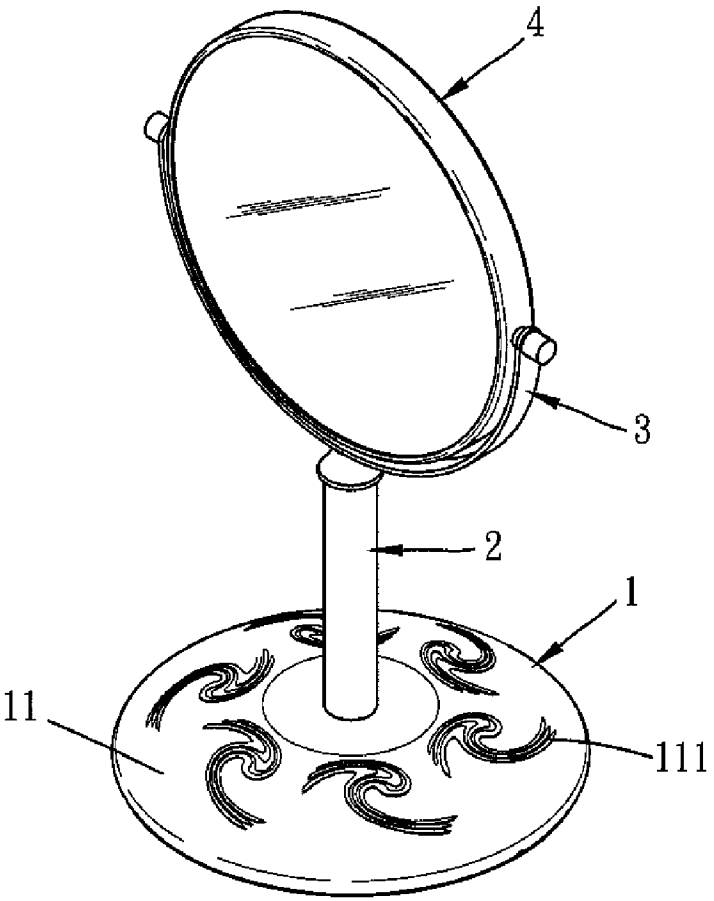
FIGS. 7A and 7B show two perspective views of two more embodiments of cosmetic pedestal mirrors in accordance with the present invention.
Figure 7A:
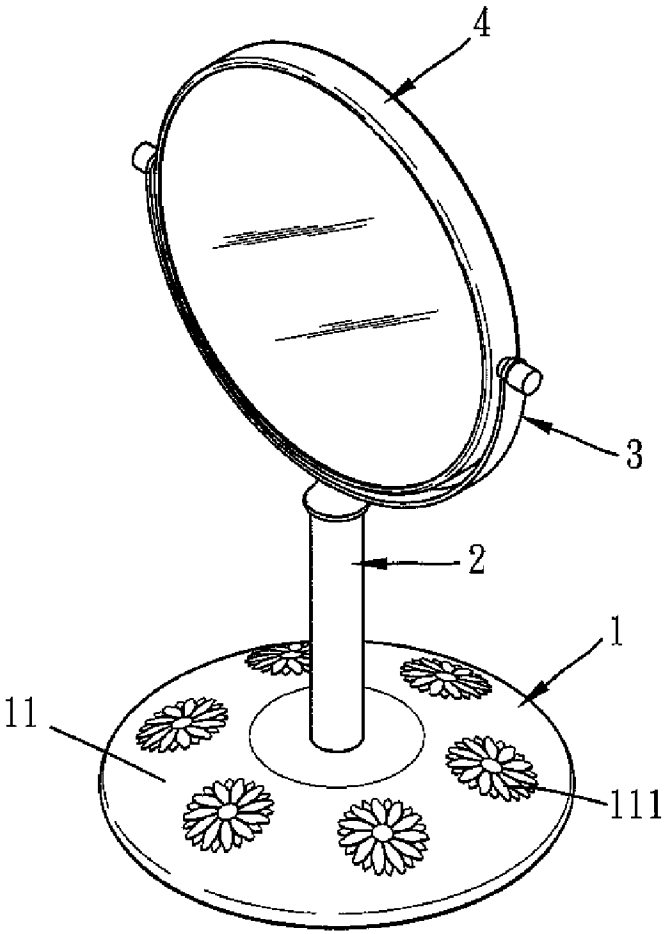

Additionally, the decorative pieces 111 on the outer surface of the glass disk hood 11 of the base 1 are selectively arranged into different patterns as shown in FIGS. 7A and 7B to have better variety.

According to the above description of the structure of the preferred embodiment, the cosmetic pedestal mirror has the benefits listed below:

1. Increased economic efficiency: By using the weighted glass disk hood 11, the base 1 has a lowered center of gravity and does not need weighting block 102 and does not need polishing and electroplating processes to reduce the manufacturing cost.

2. Environmental product: Because the glass disk hood 11 without an electroplating coating replaces the conventional metal outer shell 101 with the weighting block 102, the base 1 can be recycled after disassembly and causes no environmental problems when the cosmetic pedestal mirror is damaged.

3. Utility: Because the glass disk hood 11 replaces the conventional metal outer shell 101 with the weighting block 102, the base 1 formed of glass does not deteriorate due to rust to obtain better utility.

4. Excellent artistry: Because the glass disk hood 11 has inlayed decorative pieces 111 and is coated with a decorative coating layer 112 on the interior surface, both can be varied in different combinations. Thus, the base 1 has increased appearance variety and improved decorative and quality efficiencies.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A cosmetic pedestal mirror comprising:

a base;

a connecting rod;

a mirror frame mounted on the connecting rod;

a mirror pivotally mounted within the mirror frame, wherein the connecting rod has a smaller-diameter bolt extending from a lower end, wherein the base is composed of a glass disk hood with an open bottom;

a bottom board closing the open bottom of the glass disk hood;

a slip-proof pad pasted on an outer surface of the bottom board;

a decorative coating layer coated on an interior surface of the glass disk hood;

a through hole defined at a center of the glass disk hood through which the smaller-diameter bolt on the lower end of the connecting rod penetrates; and a through hole defined at a center of the bottom board through which the smaller-diameter bolt penetrates, wherein the glass disk hood has an outer surface and multiple decorative pieces embedded in the outer surface.

2. The cosmetic pedestal mirror as claimed in claim 1, wherein the multiple decorative pieces on the glass disk hood are arranged in patterns.

* * * * *